US009460620B2

(12) United States Patent
Evans

(10) Patent No.: US 9,460,620 B2
(45) Date of Patent: Oct. 4, 2016

(54) SYSTEMS AND METHODS FOR DETECTING YELLOW TRAP SEQUENCES

(71) Applicant: EBERLE DESIGN, INC., Phoenix, AZ (US)

(72) Inventor: Scott Richard Evans, Gilbert, AZ (US)

(73) Assignee: EBERLE DESIGN, INC., Phoenix, AZ (US)

( * ) Notice: Subject to any disclaimer, the term of this patent is extended or adjusted under 35 U.S.C. 154(b) by 85 days.

(21) Appl. No.: 14/215,274

(22) Filed: Mar. 17, 2014

(65) Prior Publication Data

US 2014/0266797 A1 Sep. 18, 2014

Related U.S. Application Data

(60) Provisional application No. 61/788,337, filed on Mar. 15, 2013.

(51) Int. Cl.

| | |
|---|---|
| ***G08G 1/095*** | (2006.01) |
| ***G08G 1/07*** | (2006.01) |
| *G08G 1/01* | (2006.01) |
| *G08G 1/16* | (2006.01) |

(52) U.S. Cl.

CPC ..... *G08G 1/07* (2013.01); *G08G 1/0133* (2013.01); *G08G 1/163* (2013.01)

(58) Field of Classification Search

CPC ..... G08G 1/0133; G08G 1/163; G08G 1/07
USPC ..... 340/931, 907
See application file for complete search history.

(56) References Cited

U.S. PATENT DOCUMENTS

| | | | | |
|---|---|---|---|---|
| 3,629,802 | A * | 12/1971 | Clark | G08G 1/097 340/931 |
| 3,810,084 | A * | 5/1974 | Hoyt, Jr. | G08G 1/085 340/916 |
| 3,870,991 | A * | 3/1975 | Hayes | G08G 1/095 340/907 |
| 4,135,145 | A * | 1/1979 | Eberle | G08G 1/097 340/642 |
| 4,896,153 | A * | 1/1990 | Pastorino | G08G 1/087 340/902 |
| 4,907,160 | A * | 3/1990 | Duncan | G08G 1/081 340/907 |
| 2003/0016143 | A1* | 1/2003 | Ghazarian | G08G 1/017 340/901 |
| 2009/0135024 | A1* | 5/2009 | Park | G08G 1/096 340/929 |

* cited by examiner

*Primary Examiner* — Jennifer Mehmood
*Assistant Examiner* — Rufus Point
(74) *Attorney, Agent, or Firm* — Lorenz & Kopf LLP

(57) ABSTRACT

A malfunction management unit includes an input/output module communicatively coupled to a controller. The input/output module is configured to monitor a sequence of intersection phases determined by the controller. A yellow trap detection module communicatively coupled to the input/output module is configured to determine whether a yellow trap sequence has occurred within the sequence of intersection phases. The yellow trap sequence may comprise a first state followed by a second state, the first state corresponding to permissive left turns in both a first direction and a second, opposing direction, and the second state corresponding to a protected left turn in the first direction.

7 Claims, 3 Drawing Sheets

SYSTEMS AND METHODS FOR DETECTING YELLOW TRAP SEQUENCES

CROSS-REFERENCE TO RELATED APPLICATIONS

This application claims priority to U.S. Prov. Pat. App. No. 61/788,337, filed Mar. 15, 2013, the contents of which are hereby incorporated by reference.

TECHNICAL FIELD

The present disclosure generally relates to traffic-control devices and, more particularly, to malfunction management units (MMU) incorporating advanced monitoring capabilities.

BACKGROUND

A malfunction management unit (MMU) is a device used in traffic control assemblies to detect and respond to conflicting or otherwise improper signals. Such improper signals may arise, for example, due to field signal conflicts, a malfunctioning controller, faulty load switches, component mis-wiring, improper supply voltages, and the like. Conventional MMUs are unsatisfactory, however, in that they may not be capable of recognizing some types of improper signals. One such type of improper signal relates to what is often referred to as the "yellow trap" sequence.

More particularly, protected/permissive left turn (PPLT) traffic controls are often used to increase the left turn capacity and reduce delay at intersections by providing an exclusive turn phase for left turns (protected) as well as a phase during which left turns can be made as gaps in opposing traffic permit (permissive). The protected left turn can either precede (lead) or follow (lag) the opposing through signal phase.

A major concern with such controls is when the change from permissive left turns in both directions to a lagging protected left turn in one direction. The left-turning driver whose permissive interval is ending may try to proceed through the intersection on the yellow indication, not realizing that the opposing through traffic still has a green through indication. This may occur when the yellow display for the adjacent through movement appears and the left-turning driver ordinarily expects the opposing through display to be yellow as well. The driver may now mistakenly believe that the left turn can be completed on the yellow indication or immediately thereafter when the opposing through display will presumably red. This sequence of events is referred to as the "yellow trap," and can lead the left turning driver into the intersection when it is possibly unsafe to do so even though the signal displays are correct.

To avoid the yellow trap, many agencies do not use leading/lagging protected/permissive left turns. Given the complexity of modern traffic control equipment, it is often difficult for field operators to correctly program traffic controller units such that actuated signal operation sequences in a safe manner avoiding the yellow trap. While signal displays have been devised to preclude the yellow trap, such as the Flashing Yellow Arrow and a scheme referred to as "Dallas Phasing," the possibility of a yellow trap occurring is still likely when unskilled technicians mis-program the traffic controller.

Accordingly, there is a need for improved systems and methods for detecting yellow trap sequences as they occur at intersections. These and other desirable features and characteristics will become apparent from the subsequent detailed description and the appended claims, taken in conjunction with the accompanying drawings and this background section.

BRIEF SUMMARY

In accordance with one embodiment, a malfunction management unit comprises an input/output module communicatively coupled to a controller, wherein the input/output module is configured to monitor a sequence of intersection phases determined by the controller; and a yellow trap detection module communicatively coupled to the input/output module, the yellow trap detection module configured to determine whether a yellow trap sequence has occurred within the sequence of intersection phases.

In accordance with another embodiment, a malfunction management method includes monitoring a sequence of intersection phases determined by a controller; and determining whether a yellow trap sequence has occurred within the sequence of intersection phases.

In accordance with another embodiment, a non-transitory media bears computer-readable software instructions configured to cause a processor to perform the steps of: monitoring a sequence of intersection phases; and determining whether a yellow trap sequence has occurred within the sequence of intersection phases.

BRIEF DESCRIPTION OF THE DRAWING FIGURES

Exemplary embodiments will hereinafter be described in conjunction with the following drawing figures, wherein like numerals denote like elements.

DETAILED DESCRIPTION

The present invention generally relates to a malfunction management unit (MMU) configured to detect a potentially dangerous yellow trap signal sequence by monitoring the sequential progression of two or more related traffic phases. In that regard, the following detailed description of the invention is merely exemplary in nature and is not intended to limit the invention or the application and uses of the invention. Furthermore, there is no intention to be bound by any theory presented in the preceding background or the following detailed description.

Figure 1:
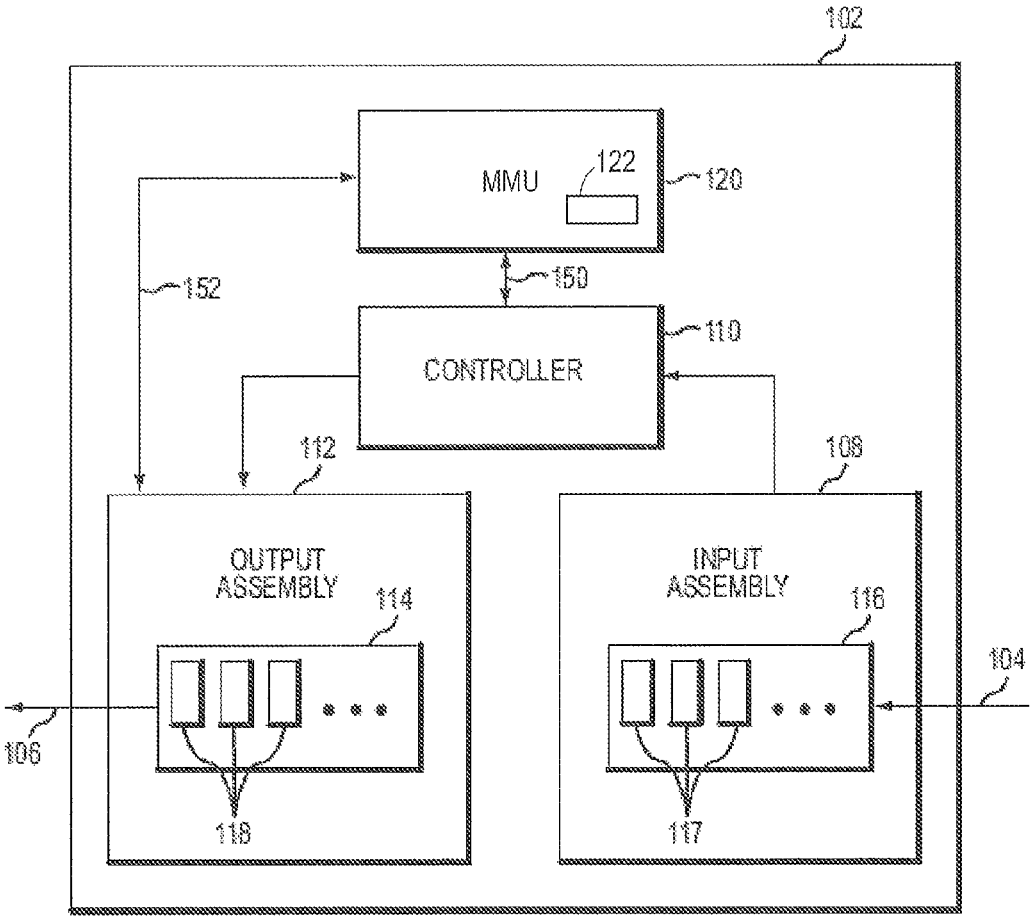
FIG. 1 is a schematic overview depicting the components of a typical traffic control cabinet in which the present invention may be deployed.

Referring to FIG. 1, a typical intersection cabinet (or simply "cabinet") 102 useful in describing the present invention generally contains an input assembly 108, an output assembly 112, a controller 110, and an MMU 120. Controller 110 is coupled to output assembly 112 and input assembly 108, as well as MMU 120. Those skilled in the art will appreciate that such cabinets vary greatly with respect to both design and components.

MMU 120 is configured to detect and respond to conflicting or otherwise improper signals caused by a malfunctioning controller 110, faulty load switches, cabinet miswiring, improper supply voltages, or other such failure mechanisms. In accordance with the present invention, MMU 120 includes a yellow trap detection module 122, which comprises any suitable combination of hardware, software, and/or non-transitory computer-readable media configured to detect a yellow trap signal sequence as described in further detail below.

Exemplary MMUs are typically configured as a 16-channel monitor, but may also have 32 channels, 12 channels, 6 channels, or any other number of channels. The term "MMU" is used to encompass any of the variety of related components whose names may vary depending upon manufacturer, such as "signal monitors," "conflict monitor units," and the like. These terms may be used interchangeably herein.

The general functional requirements of conventional MMUs are covered by a variety of standards, including, for example, National Electrical Manufacturers Association (NEMA) TS2-2003, Traffic Controller Assemblies with NTCIP Requirements, v02.06, NEMA TS1-1989 (rev. 2000), Traffic Control Systems, AASHTO/ITE/NEMA Intelligent Transportation Systems (ITS) Standard Specification for Roadside Cabinets, v 01.03, Caltrans Transportation Electrical Equipment Specifications (TEES), August 2002. In this regard, MMUs are often referred to in terms of which standards they conform to, including, for example, NEMA TS-2 signal monitors, NEMA TS-1 signal monitors, 2010 signal monitors, 210 signal monitors, ITS signal monitors, etc. It will be appreciated that the present invention is not limited to any of these particular standards or types of signal monitors.

Referring again to FIG. 1, input assembly 108 typically includes an array 116 of input devices (such as vehicle detectors 117) which receive input signals 104 from the intersection environment through imbedded inductive loops and/or other such sensors. Similarly, output assembly 112 typically includes a set 114 of output devices (such as load switches 118) which communicate with the environment via output 106 to effect traffic control via activation of the appropriate traffic signals. To do so, controller 110 communicates with and controls the various assemblies within cabinet 102. The present invention is not limited, however, to specific controller units or communication protocols.

MMU 120 may be configured such that it receives and processes signals not only from output assembly 112, but also controller 110. In this way, MMU 120 provides "field checking." That is, MMU 120 is capable of determining the output of load switches 118 while at the same time monitoring what controller 110 has instructed those outputs to be.

In conventional MMU designs, when one or more critical failures occur, the MMU instructs (or, more generally, causes other components to instruct) the signal lights to enter an emergency "flash" mode, in which the traffic lights on all sides of the intersection generally enter a flashing red state. More particularly, a flash transfer relay (not illustrated) within output assembly 112 is typically instructed directly by MMU 120 to enter the flash mode. The nature of such flash modes, transfer relays, and load switches are known in the art, and need not be described in detail herein.

Figure 2:
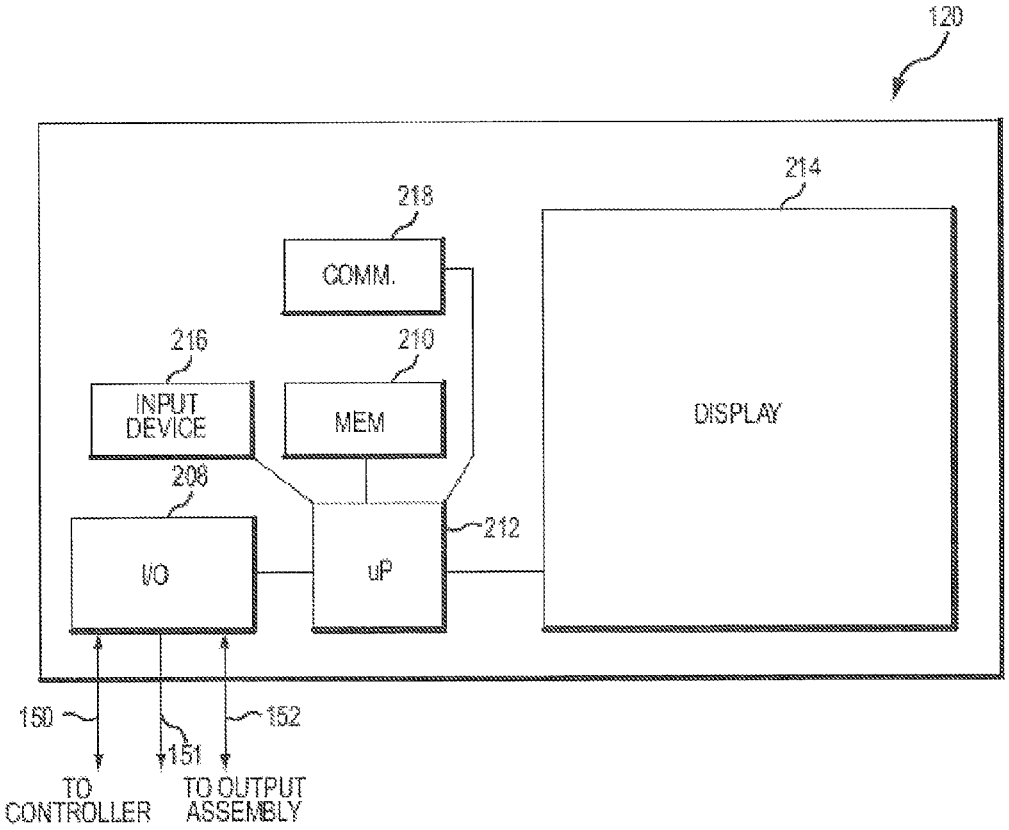
FIG. 2 is a schematic block diagram of a malfunction management unit (MMU) in accordance with one embodiment.

FIG. 2 is a simplified block diagram of an MMU 120 in accordance with the present invention, which generally includes a display 214, a memory 210 (e.g., RAM, ROM, EEPROM, or combination thereof), a microprocessor or microcontroller 212, input/output (I/O) circuitry (or simply "I/O module") 208, a user communication port 218, and one or more input devices (e.g., keypads, keyboards, mice, touchpads, etc.) 216. A yellow trap detection module as illustrated in FIG. 1 is implemented within MMU 120 using any combination of hardware and/or software. Furthermore, it will be understood that numerous other electronic components will typically be present in such a system, but have been removed in the figures for the purpose of clarity.

Display 214 of MMU 120 comprises one or more display components capable of displaying information pertinent to the operation of the system as described herein. In this regard, display 214 may include one or more displays of any type now known or developed in the future, including without limitation liquid crystal displays (LCDs), light emitting diode (LED) displays, electroluminescent displays, and the like. Similarly, such displays might be general-purpose, pixel-based displays or custom displays with dedicated display components ("icon-based"), or a combination thereof.

Display 214 is preferably interactive (or "navigable") in that its displayed content is responsive to input device 216—e.g., one or more buttons, touch screen signals, or any form of direct or indirect input. In this regard, the present invention is not limited to any particular size, shape, geometry, or configuration of inputs and outputs. Furthermore, the present invention may be implemented in a device that does not include a display or input device, provided that some form of external user interface (coupled wirelessly or via a wired connection) is provided for programming the operable features of MMU 120.

I/O 208 communicates via line 150 with controller 110 (not shown in FIG. 2), and communicates via line 152 with the various load switches in the output assembly (i.e., the "field"). Furthermore, a line 151 provides an output signal to the flash control circuitry (not shown). That is, signal 151 may used, in part, to instruct the flash transfer relay(s) to place the traffic intersection into an emergency mode (e.g., via flashing red intersection signals) in the event that a "critical" or "non-critical" fault has occurred. MMU 120 may also be capable of reporting the occurrence of such events to an external server or other entity.

The operation of conventional flash control outputs and load switches is well known in the art, and need not be described herein. Line 150 is shown as a single communication channel, but it will be understood that it may include multiple lines and communication channels configured to interface with one or more inputs and outputs on the controller unit. The nature of the physical interface between controller 110 and MMU 120 will vary depending upon the specific hardware and applicable standards being used.

Communication port 218 may be provided to allow an operator to upload various configuration settings (e.g., settings related to the interrelationship of the various phases of the intersection) which are suitably stored. This port may implement any suitable protocol and may include any convenient connector technology as is known in the art.

Figures 3, 4:
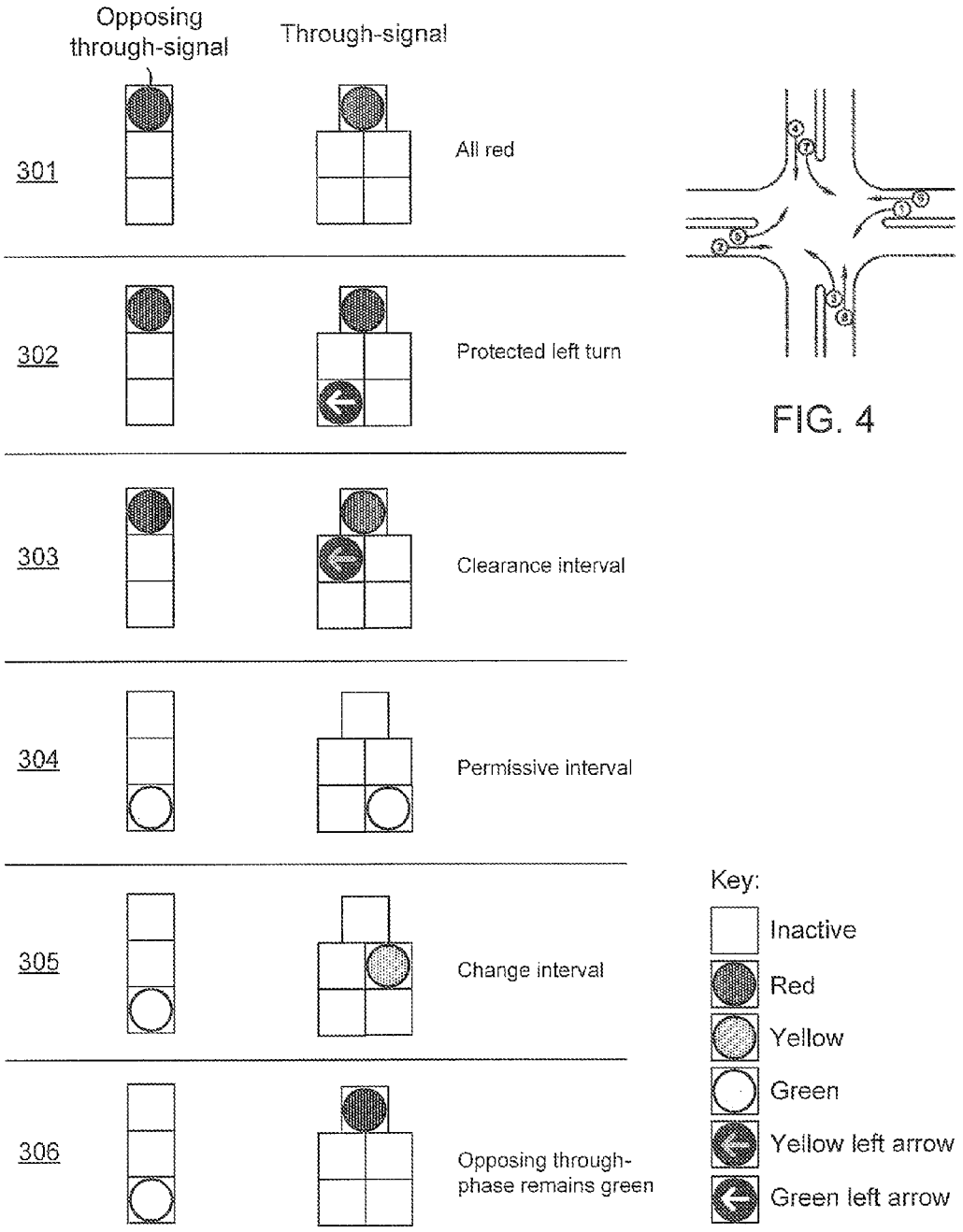
FIG. 3 depicts a sequence of traffic signal states including a yellow trap sequence.
FIG. 4 depicts common phase definitions for an example intersection.

Having thus given an overview of an exemplary MMU, the operation of yellow trap detection module 122 (FIG. 1) will now be described. Toward that end, FIG. 3 presents a sequence of signal states progressing from the top to the bottom (sequences 301-306). For each sequence, two example signal heads are illustrated: on the right, a signal head corresponding to a through signal in combination with left turn arrows, and on the left, a signal head corresponding to an opposing through-signal. For simplicity, the left turn signals corresponding to the opposing through-signal are not illustrated.

The types of signal heads illustrated are not intended to be limiting, but are only presented as examples. In the case of the opposing through signal, the signal head is illustrated as comprising, from top to bottom, a red, a yellow, and a green light. In the case of the through-signal/left turn signal on the right, the signal head is illustrated as comprising a red light on top and two pairs of vertical lights on the bottom: on the left, a yellow left arrow over a green left arrow, and on the right, a yellow light over a green light, as is conventional. As will become clear, the red, yellow, and green lights of the through-signal on the right are not necessary for detection of a yellow trap sequence, but are merely shown for understanding of the overall signal sequence.

Referring momentarily to the intersection diagram illustrated in FIG. 4, the different phases of an intersection may be numbered (in this case, in accordance with typical conventions) from 1 to 8. Depending upon the design of a particular intersection, a greater number or a lower number of phases may be defined. In the illustrated embodiment, for example, phase 2 consists of a through-signal, phase 6 corresponds to the opposing through-signal, and phase 1 corresponds to a left turn opposite phase 2.

Referring again to FIG. 3 in conjunction with FIG. 4, at state 301, all signals are red, with no left turn signals active. This is followed by sequence 302, wherein the green left turn signal is activated. This is a "protected left turn" condition in which, for example, vehicles at phase 1 could turn safely with respect to phase 2. The protected left turn state may either precede (lead) or follow (lag) the through-signal phase.

Next, in state 303, a "clearance interval" occurs. That is, the left turn signal changes from green arrow, to yellow arrow, as shown. This warns the turning vehicle that the protected left turn sequence will soon end. Sequence 303 is followed by a "permissive left turn interval," 304, during which both the through-signal and the opposing through-signal change to green. This is followed by state 305, a "change interval" in which the through-signal changes to yellow. Finally, at state 306, the through signal changes to red while the opposing through-signal remains green.

The yellow trap sequence arises out of the transition from states 304 to 305. That is, the yellow trap sequence occurs during the change from permissive left turns in both directions (state 304) to a lagging protected left turn in one direction (the opposing signal). The left turning driver (e.g., phase 1) whose permissive interval is ending may attempt to proceed through the intersection on the yellow indication, not realizing that the opposing through traffic still has a green through indication. As mentioned previously, this may occur when the yellow display for the adjacent through movement appears and the left-turning driver ordinarily expects the opposing through display to be yellow as well. This yellow trap condition essentially leads the left turning driver into the intersection when it is possibly unsafe to do so even though the signal displays are correct.

Referring again to FIG. 1, in accordance with the present invention, yellow trap detection module (or simply "module") 122 of MMU 120 is configured to detect that such a condition has occurred or may occur. In response, MMU 120 may instruct the flash transfer relay(s) to place the traffic intersection into an emergency mode (e.g., via flashing red intersection signals) or another alarm condition. This might be considered a critical alarm, but might also be considered a non-critical alarm in some embodiments. In some instances, a yellow trap condition might be preferred to a more dangerous alternative.

To detect a yellow trap sequence, module 120 monitors the sequence of states as they progress at the intersection (i.e., indirectly via controller 110). In particular, module 120 monitors at least two opposing phases and determines whether a sequence such as that depicted by states 304 and 305 of FIG. 3 has occurred. For example, referring to FIG. 4 in conjunction with FIG. 1, module 120 may know, a priori, that phase 2 is an east-bound through phase, phase 6 is the opposing through-phase, and phase 1 is the corresponding protected left turn phase. Module 120 then watches for a sequence that progresses from a state with permissive left turn in the phase 1 direction while phase 2 and 6 are both green, followed by the phase 6 going to yellow while phase 2 is still green. Such a sequence would be considered a yellow trap sequence for the left turn motorist. Similarly, a sequence that progresses from a state with permissive left turn in the phase 5 direction while phase 2 and 6 are both green, followed by the phase 2 going to yellow while phase 6 is still green would be considered a yellow trap sequence.

Referring to FIG. 1 together with FIG. 2, yellow trap detection module 120, in one embodiment, comprises machine-readable software instructions stored in memory 210, which is then executed by processor 212 as it monitors the intersection via I/O module 208. Memory 210 also stores whatever information is necessary in order to determine whether a yellow trap sequence has occurred. As described above, this would typically include data that associates two or more phases with each other. For example, consistent with the illustration embodiment above, memory 210 may be used to store a configuration file that associates phase 6 with phase 2, and phase 1. In general, the module needs to know the channel assignment of the two related opposing phases and the channel assignments of the related protected left turn phases. This programming is provided for each direction to be monitored. In other embodiments, this association is configured using hardware (e.g., switches or the like).

While several exemplary embodiments have been presented in the foregoing detailed description, it should be appreciated that a vast number of alternate but equivalent variations exist, and the examples presented herein are not intended to limit the scope, applicability, or configuration of the invention in any way. To the contrary, various changes may be made in the function and arrangement of elements described without departing from the scope of the claims and their legal equivalents.

For simplicity and clarity of illustration, the drawing figures depict the general topology, structure and/or manner of construction of the various embodiments. Descriptions and details of well-known features and techniques may be omitted to avoid unnecessarily obscuring other features. For example, conventional techniques and components related to traffic control devices are not described in detail herein. Elements in the drawings figures are not necessarily drawn to scale: the dimensions of some features may be exaggerated relative to other elements to assist improve understanding of the example embodiments.

Terms of enumeration such as "first," "second," "third," and the like may be used for distinguishing between similar elements and not necessarily for describing a particular spatial or chronological order. These terms, so used, are interchangeable under appropriate circumstances. The embodiments of the invention described herein are, for example, capable of use in sequences other than those illustrated or otherwise described herein. Unless expressly stated otherwise, "connected," if used herein, means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically.

The terms "comprise," "include," "have" and any variations thereof are used synonymously to denote non-exclusive inclusion. The terms "left," right," "in," "out," "front," "back," "up," "down," and other such directional terms are used to describe relative positions, not necessarily absolute positions in space. The term "exemplary" is used in the sense of "example," rather than "ideal."

What is claimed is:

1. A malfunction management unit comprising:

an input/output module communicatively coupled to a controller, wherein the input/output module is configured to monitor a sequence of intersection phases determined by the controller; and a yellow trap detection module communicatively coupled to the input/output module, the yellow trap detection module configured to determine whether a yellow trap sequence has occurred within the sequence of intersection phases, wherein the yellow trap sequence comprises a first state followed by a second state, the first state corresponding to permissive left turns in both a first direction and a second, opposing direction, and the second state corresponding to a protected left turn in the first direction.

2. The malfunction management unit of claim 1, wherein the yellow trap detection module comprises a memory having configuration data stored therein, the configuration data including a list of one or more of the intersection phases and the relationship between the one or more intersection phases.

3. The malfunction management unit of claim 2, wherein the yellow trap detection module includes machine readable instructions stored in the memory and executable by a processor.

4. A malfunction management method comprising:

monitoring a sequence of intersection phases determined by a controller; and determining whether a yellow trap sequence has occurred within the sequence of intersection phases, wherein the yellow trap sequence comprises a first state followed by a second state, the first state corresponding to permissive left turns in both a first direction and a second, opposing direction, and the second state corresponding to a protected left turn in the first direction.

5. The method of claim 4, further including storing configuration data including a list of one or more of the intersection phases and the relationship between the one or more intersection phases.

6. Non-transitory media bearing computer-readable software instructions configured to cause a processor to perform the steps of:

monitoring a sequence of intersection phases; and determining whether a yellow trap sequence has occurred within the sequence of intersection phases, wherein the yellow trap sequence comprises a first state followed by a second state, the first state corresponding to permissive left turns in both a first direction and a second, opposing direction, and the second state corresponding to a protected left turn in the first direction.

7. The non-transitory media of claim 6, wherein the software instructions further cause the processor to store, in a memory, configuration data including a list of one or more of the intersection phases and the relationship between the one or more intersection phases.

* * * * *